US008767990B2

(12) United States Patent
Spragge et al.

(10) Patent No.: US 8,767,990 B2
(45) Date of Patent: Jul. 1, 2014

(54) HEARING AID WITH A CHILD-PROOF BATTERY COMPARTMENT

(75) Inventors: Peter Spragge, Smørum (DK); Michael F. Jørgensen, Smørum (DK); Rune Værndal, Esbjerg (DK)

(73) Assignee: Oticon A/S, Smorum (DK)

( * ) Notice: Subject to any disclaimer, the term of this patent is extended or adjusted under 35 U.S.C. 154(b) by 1092 days.

(21) Appl. No.: 12/719,659

(22) Filed: Mar. 8, 2010

(65) Prior Publication Data

US 2010/0226519 A1 Sep. 9, 2010

(30) Foreign Application Priority Data

Mar. 9, 2009 (EP) ..... 09154613

(51) Int. Cl.
*H04R 25/00* (2006.01)

(52) U.S. Cl.
USPC ..... 381/322; 381/323; 381/330; 381/312

(58) Field of Classification Search
USPC ..... 381/322, 330
See application file for complete search history.

(56) References Cited

U.S. PATENT DOCUMENTS

| | | | | |
|---|---|---|---|---|
| 5,386,476 | A * | 1/1995 | Bisgaard et al. | 381/323 |
| 7,916,883 | B2 * | 3/2011 | Crook | 381/322 |
| 8,270,646 | B2 * | 9/2012 | Heerlein et al. | 381/323 |
| 2007/0081684 | A1 | 4/2007 | Crook | |

FOREIGN PATENT DOCUMENTS

| | | | |
|---|---|---|---|
| DK | 93 07 905.2 | U1 | 10/1994 |
| DK | 94 13 843.5 | U1 | 10/1994 |
| EP | 0 674 465 | A1 | 9/1995 |

* cited by examiner

*Primary Examiner* — Davetta W Goins
*Assistant Examiner* — Jasmine Pritchard
(74) *Attorney, Agent, or Firm* — Birch, Stewart, Kolasch & Birch, LLP

(57) ABSTRACT

A hearing aid with a child-proof battery compartment includes a shell and a battery door mounted in the shell for rotational movement between an open position and a closed position. A latch mechanism between a pivotal latch of the battery door and a corresponding arrest part is at an internal side of an arrest wall. The battery door in the closed position includes external wall parts facing away from the hearing aid and all of the external wall parts are flush with or recessed with respect to adjacent wall parts of the hearing aid shell, such that an opening force cannot be applied to the external wall parts. The arrest wall includes a narrow gap opening which grants access to the pivotal latch and allows an opening force to be applied to the pivotal latch through the opening to release the battery door.

3 Claims, 4 Drawing Sheets

HEARING AID WITH A CHILD-PROOF BATTERY COMPARTMENT

TECHNICAL FIELD

The present invention relates to a hearing aid. The invention relates specifically to a hearing aid comprising a shell shaped for placement behind the ear lobe of a hearing aid user whereby a battery door is mounted in the shell for rotational movement between an open position for granting access to a battery and a closed position where a latch mechanism is provided between a pivotal latching part of the battery door and a corresponding arrest part at an internal side of an arrest wall forming part of the hearing aid shell for arresting the battery door in its closed position where the pivotal latch has a proximal part and a distal part and the distal part is arranged to pivot in order to release the battery door from the arrest part when an opening force is applied to the latch.

BACKGROUND ART

The following account of the prior art relates to one of the areas of application of the present invention, namely in connection with hearing aid instruments with a behind the ear part comprising an exchangeable battery.

US publication No 2007/0081684 relates to a hearing aid with a battery compartment having a battery lid or battery access door which is hingedly connected to the casing to allow pivotal motion between the battery door and the casing, where a flexible latch having a proximal end and a distal end is provided at the battery door, where the distal end of the flexible locking latch is arranged to flex along a path in order to release the battery door and wherein an arrest pin is insertable in the moving path of the distal part of the flexible locking latch to block the movement of the latch when a child-resistant battery enclosure is desired. This example of prior art suffers from the problem that the locking pin ads un-necessary complexity to the construction and that it may also accidentally fall out and thus the effect of childproofing is gone.

Further, from EP 0674465 a hearing aid with childproofing of the battery door is known, where the door may be opened by the insertion of a screwdriver or the like into a small aperture between battery door and the hearing aid shell. The aperture is provided behind a protrusion which prevents a child from reaching into the aperture. The problem with this prior art child proofing is that the protrusion leaves plenty of possibility for the child to open the battery door using mouth and teeth, and a reliable security against attempts to open the battery door is not achieved. Also the protrusion is cosmetically unattractive and therefore undesirable.

DISCLOSURE OF INVENTION

The problem of the prior art is thus that there is no suggestions as to how to make a simple and reliable child proof battery door in a hearing aid, without compromising demands to size and cosmetic attractiveness of the hearing aid.

An object of the present invention is to provide a hearing aid with a behind the ear part containing at least an exchangeable battery and a battery door, wherein the battery door may be closed and locked in such a manner that a child cannot readily gain access to the battery, and whereby the complexity of the battery door is not an obstacle to production and reliability of the battery door.

Objects of the invention are achieved by the invention described in the accompanying claims and as described in the following.

An object of the invention is achieved by a hearing aid comprising a shell shaped for placement behind the ear lobe of a hearing aid user whereby a battery door is mounted in the shell for rotational movement between an open position for granting access to a battery and a closed position where a latch mechanism is provided between a pivotal latching part of the battery door and a corresponding arrest part at an internal side of an arrest wall forming part of the hearing aid shell for arresting the battery door in its closed position where he pivotal latch has a proximal part and a distal part and the distal part is arranged to pivot in order to release the battery door from the arrest part when an opening force is applied to the latch. The hearing aid is special in that, the battery door in the closed position comprise external wall parts facing away from the hearing aid and where all such external wall parts are flush with or recesses with respect to adjacent wall parts of the hearing aid shell such that an opening force cannot be applied to these external wall parts and wherein further, the arrest wall of the hearing aid shell comprise a fissure which grants access to the pivotal latch and allows an opening force to be provided to the latch through said fissure with the use of a pointy implement.

With a hearing aid made with the above provisions, it is ensured, that firstly no surface is readily provided where any kind of opening force may be applied, and also by providing the surface, whereto the opening force is to be applied, behind the fissure in the arrest wall, it is ensured that no small children will be able to accidentally open the battery drawer as not only does this require the use a pointy implement, but also good dexterity and some insight into the workings of the construction.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 1:
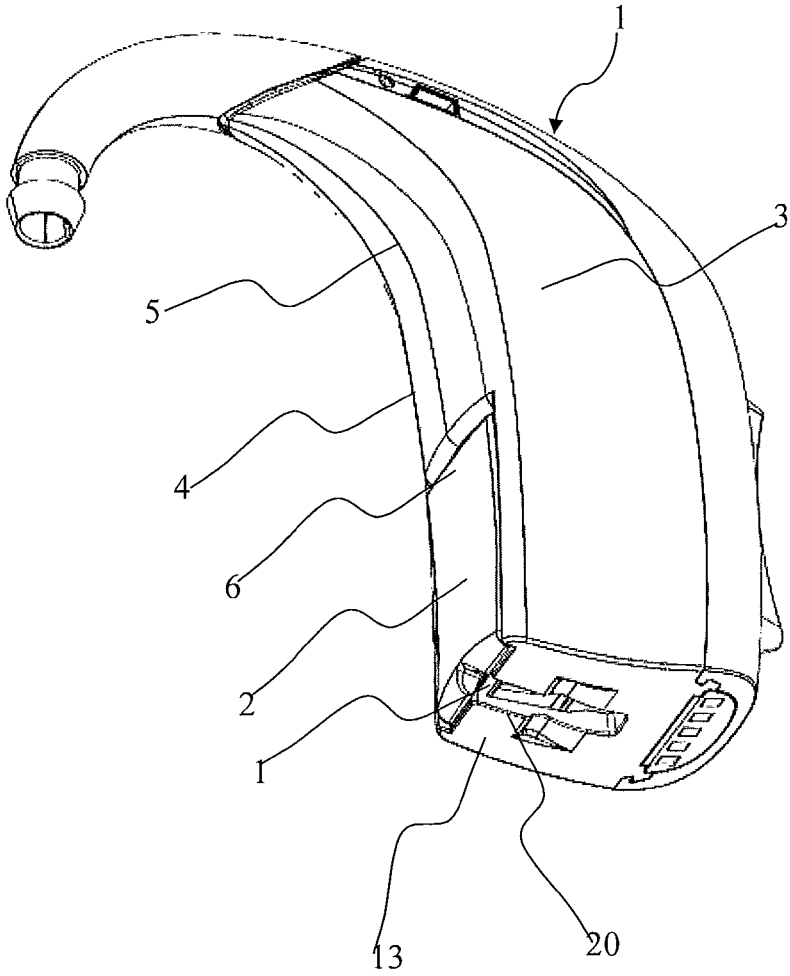
FIG. 1 shows a hearing aid according to the invention in a 3d projection.
Figure 2:
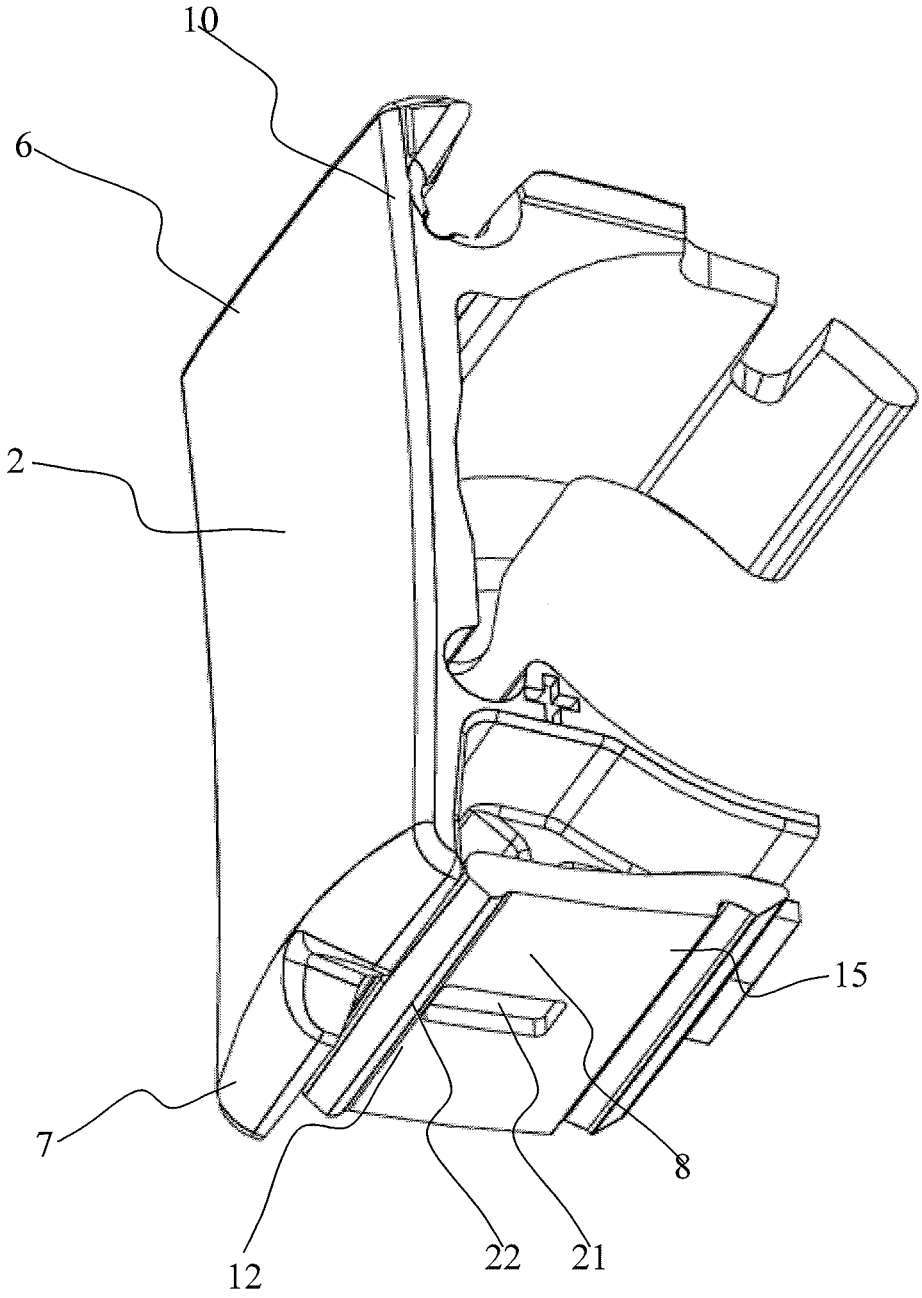
FIG. 2 shows a battery drawer in the same projection as in FIG. 1 in an enlarged scale and without any other components of the hearing aid.

FIG. 1 shows a hearing aid according to the invention in a 3d projection, and in the figure a shell 1 shaped for placement behind the ear lobe of a hearing aid user is seen. The shell 1 encloses electronic circuitry, which among others comprise microphones and an amplifier. A power supply for the circuitry is arranged by way of an exchangeable battery (not shown). A battery lid 2 is mounted in the shell 1 for rotational movement between an open position for granting access to the battery and the closed position shown in FIG. 1. The hearing aid shell 1 is composed of a first side wall 3, and a second side wall 4 arranged generally opposed to each other and a bottom wall 5. When placed on the ear of a user the bottom wall 5 will abbot abut the ear and one side wall will face the head of the user and the opposed side wall will be facing away from the user. The battery door 2 is attached to the shell 1 by a hinge having a bearing 10 at the one end of the battery door 2 and a hinge pin 11 at the shell 1. As seen in FIG. 2 the bearing 10 is open to one side, such that it may be snapped onto the hinge pin 11 in a way common in the art.

Figure 3:
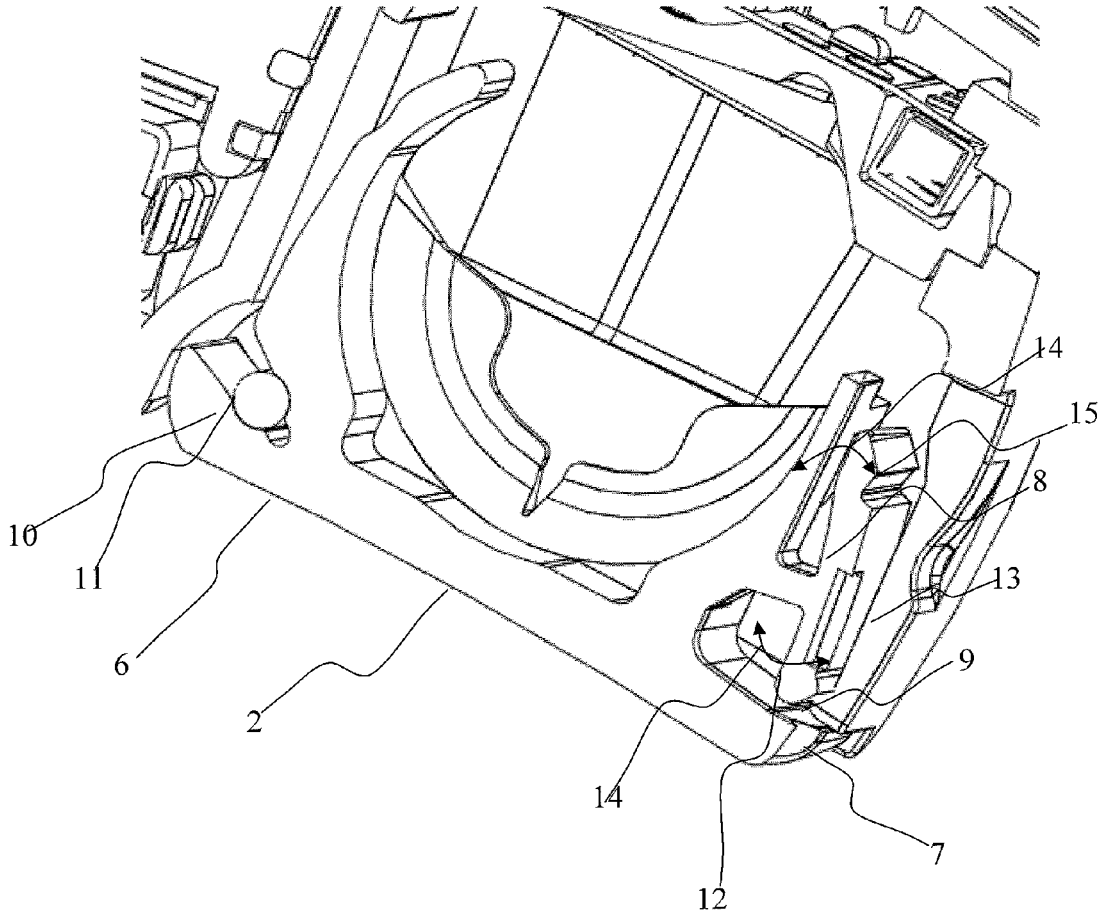
FIG. 3 shows a sectional view in a 3d projection of the interior of the hearing aid with the battery door in place.

At an opposed end of the battery door 2 a latch mechanism (best seen in FIG. 3) is provided between parts of the battery door 2 and the shell, and will be described in detail with reference to FIGS. 2 and 3. FIG. 2 shows a battery drawer in the same projection as in FIG. 1 in an enlarged scale and without any other components of the hearing aid. A pivotal latching part 8 of the battery lid 2 is arranged to pivot to secure latching between a distal part 12 thereof and an internal side of an arrest wall 13 forming part of the hearing aid shell 1 for arresting the battery lid 2 in its closed position. FIG. 3 shows a sectional view in a 3d projection of the interior of the hearing aid with the battery door in place. As seen here the distal part 12 of the latch comprise a protrusion, and an opposed protrusion 9 is provided at the arrest wall 13, and in order for the battery lid to open the latching element 8 must pivot back and forth as indicated by arrows 14. The pivotal latch has a proximal part with a recess 15, which may catch the protrusion 9 of the arrest wall 13 during opening motion of the battery door 2, thereby ensuring a fixed position of the door, wherein the battery is not being contacted and the hearing aid is off power.

The battery door 2 in the closed position comprise external wall parts 6, 7 facing away from the hearing aid and as seen in FIG. 1 and FIG. 2 all such wall parts 6, 7 are flush with or recessed with respect to adjacent wall parts of the hearing aid shell 1 such that an opening force cannot be applied to these external wall parts 6, 7 and as a result of this small children will not be able to open the door 2. In order for the door to open a pointy implement must be inserted into the fissure 20 at the arrest wall 13 in order to put pressure onto the pivotal latch 8. A ball pen or similar writing tool will be suitable for this.

The pivotal latch 8 has a notch 21 with an edge 22 at the distal end of the latch in order to allow an implement a secure foothold such that pressure may easily be applied from outside to the latch. In order to open the battery door it is thus necessary that the user understands the workings of the opening mechanism, and at the same time has the dexterity of a grown person. This prohibits small children from opening the battery drawer.

Figure 4:
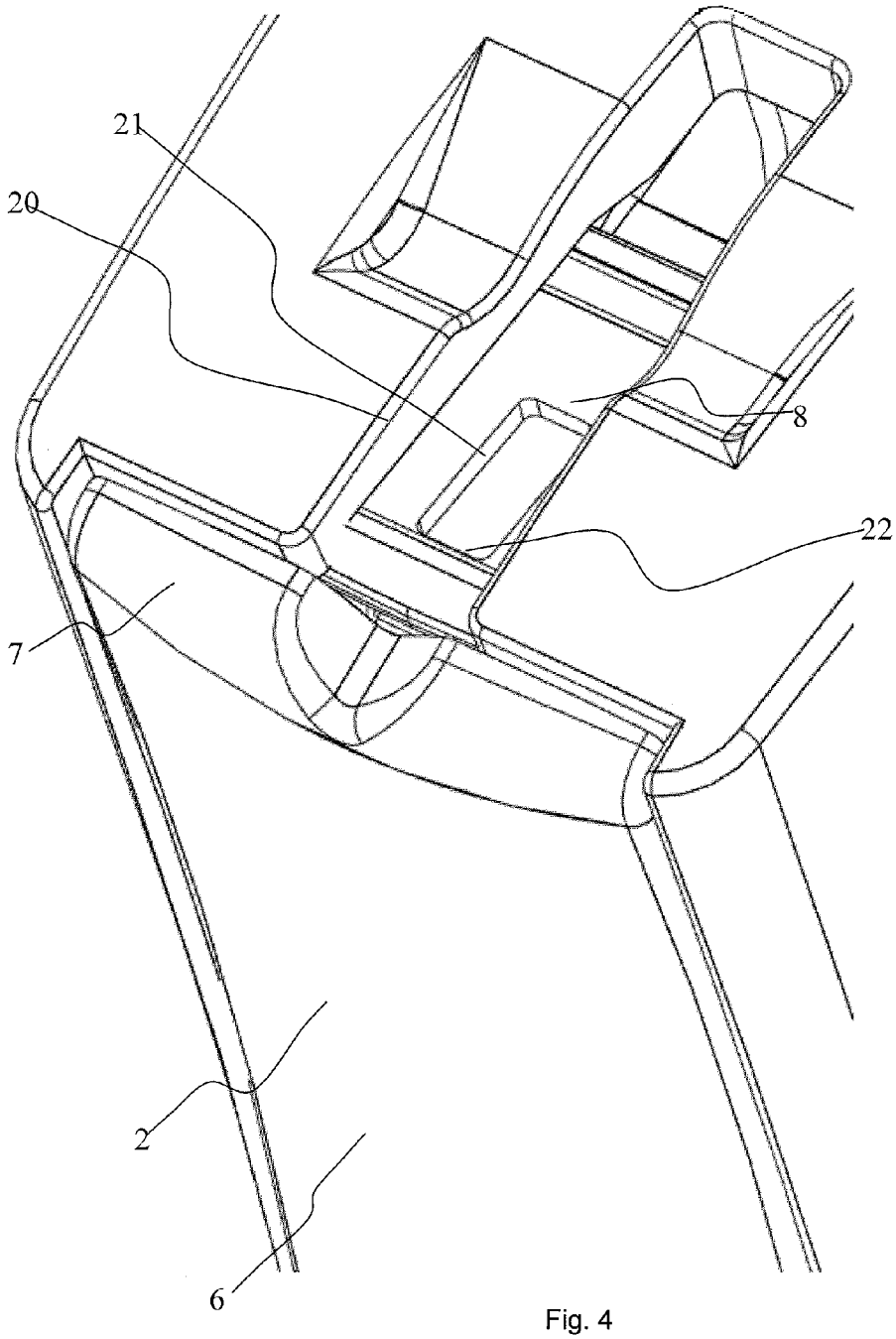
FIG. 4 shows and enlarged view in 3d projection of the battery door from the outside, The figures are schematic and simplified for clarity, and they show details which are essential to the understanding of the invention, while other details may be present in the figures without having any bearing on the invention. Throughout, the same reference numerals are used for identical or corresponding parts.

FIG. 4 shows and enlarged view in 3d projection of the battery door from the outside. From this figure it is clear that there are no edges or protrusions of the battery door 2, which would allow a user to open the door 2 without entering an implement into the fissure 20 in order to put pressure to the latch 8.

The invention is defined by the features of the independent claim. Preferred embodiments are defined in the dependent claims. Any reference numerals in the claims are intended to be non-limiting for their scope.

The invention claimed is:

1. A hearing aid, comprising:

a shell shaped for placement behind the ear lobe of a hearing aid user;

a battery door mounted in the shell for rotational movement between an open position for granting access to a battery and a closed position, the battery door including a pivotal latch;

a latch mechanism provided between the pivotal latch of the battery door and a corresponding arrest part at an internal side of an arrest wall forming part of the hearing aid shell for arresting the battery door in its closed position;

a sidewall facing the head of the user, an opposed side wall facing away from the user, and a bottom wall intended to abut the ear of the user once the hearing aid is rightly placed behind the ear, said arrest wall being arranged generally perpendicular to the side and bottom walls, wherein the pivotal latch includes a proximal part, and a distal part, and the distal part is arranged to pivot in order to release the battery door from the arrest part when an opening force is applied to the pivotal latch, the battery door in the closed position includes external wall parts facing away from the hearing aid and all said external wall parts are flush with or recessed with respect to adjacent wall parts of the hearing aid shell, such that an opening force cannot be applied to the external wall parts, the arrest wall of the hearing aid shell includes a fissure which grants access to the pivotal latch and provides an opening through which an opening force is applied perpendicularly to the pivotal latch through said fissure to release the battery door, the external wall parts of the battery door facing away from the hearing aid battery door are arranged to form a part of the bottom wall adjacent to the arrest wall when the battery door is closed, the pivotal latch extends along an internal side of the arrest wall with the distal part of the pivotal latch arranged for pivotal movement towards and away from the arrest wall, the pivotal latch in an area facing the fissure has a recess with an edge at the distal end of the pivotal latch in order to allow a pointy implement to secure foothold at said edge, and the pivotal latch is attached to the battery door at a midpoint between the proximal and the distal part of the pivotal latch, through a cantilever arranged to flex and thereby facilitate the pivotal movement of the pivotal latch.

2. The hearing aid as claimed in claim 1, wherein the proximal part of the pivotal latch comprises a further latch part allowing the proximal part to latch on to the arrest wall at a halfway open position of the battery door where the battery is disconnected from battery terminals inside the hearing aid casing.

3. The hearing aid as claimed in claim 2, wherein the battery door at the inside of one of said external wall parts is distanced from the pivotal latch and includes a bearing arranged to receive a hinge pin of the hearing aid shell in order to facilitate rotational action of the battery door between closed and opened position.

* * * * *